US005154640A

United States Patent [19]

Chen et al.

[11] Patent Number: 5,154,640

[45] Date of Patent: Oct. 13, 1992

[54] ACCESSORY FUSE CONNECTOR

[76] Inventors: George H. Chen, 10035 Variel Ave., Chatsworth, Calif. 91311; Steven R. Maheux, 8527 Cantalope Ave., Panorama City, Calif. 91402

[21] Appl. No.: 683,445

[22] Filed: Apr. 9, 1991

Related U.S. Application Data

[63] Continuation of Ser. No. 531,571, Jun. 1, 1990, abandoned.

[51] Int. Cl.[5] ..... H01R 13/68

[52] U.S. Cl. ..... 439/621

[58] Field of Search ..... 439/621, 622; 337/187, 337/188, 255

[56] References Cited

U.S. PATENT DOCUMENTS

| | | | |
|---|---|---|---|
| 2,649,522 | 8/1953 | Marcus | 439/622 |
| 4,097,109 | 6/1978 | Cross | 439/557 |
| 4,306,158 | 12/1981 | Ogle | 307/10.8 |
| 4,372,638 | 2/1983 | Sohler | 439/857 |
| 4,761,148 | 8/1988 | Sappington | 439/621 |
| 4,846,733 | 7/1989 | Baïsz et al. | 439/622 |
| 4,988,313 | 1/1991 | Castlebury | 439/621 |

FOREIGN PATENT DOCUMENTS

| | | | |
|---|---|---|---|
| 2548141 | 5/1977 | Fed. Rep. of Germany | 337/187 |
| 1554392 | 1/1969 | France | 439/851 |

OTHER PUBLICATIONS

IBM Technical Disclosure Bulletin, "Straight-Through Connection", vol. 13, No. 11, p. 3341, Apr. 1971.

*Primary Examiner*—Gary F. Paumen

*Attorney, Agent, or Firm*—Kenneth J. Hovet

[57] ABSTRACT

An accessory fuse connector is provided that attaches to a fuse housing and provides electrical communication between the fuse and the original vehicle circuitry. Attachment legs secure the connector to the fuse housing and function to position an elongated contact arm over an exposed part of the fuse circuitry. The arm has an end tab and/or projection that contacts the exposed part so that current may be transmitted back through the arm and connector to an accessory connector tab. The desired accessory can then be operated by wiring it to the connector tab. When the connector is used in association with a blade or plastic sheathed fuse, a non-conductive spacer is attached to the connector body to enhance attachment and prevent a short circuit.

15 Claims, 2 Drawing Sheets

Fig. 1
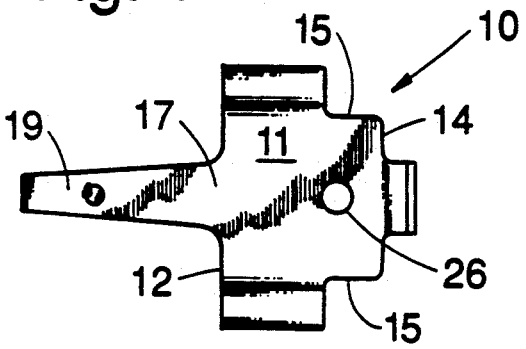
Fig. 3
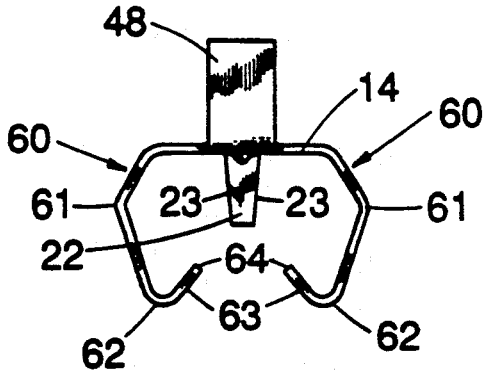
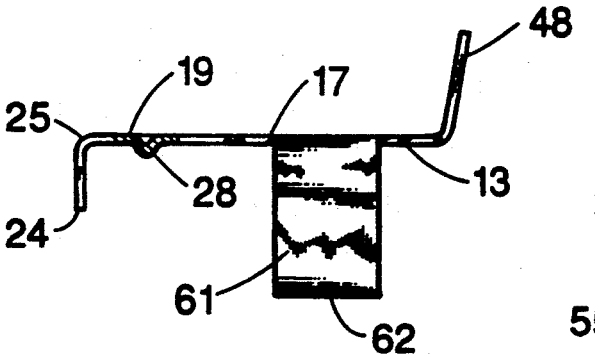
Fig. 2
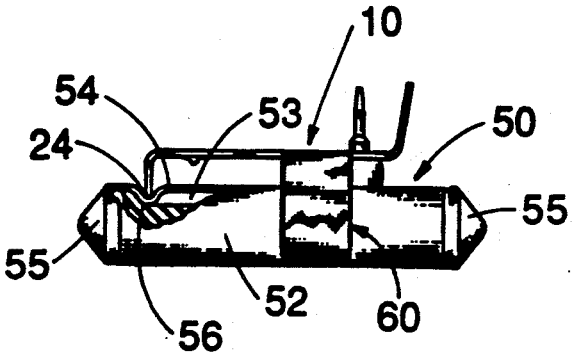
Fig. 9

Fig. 4
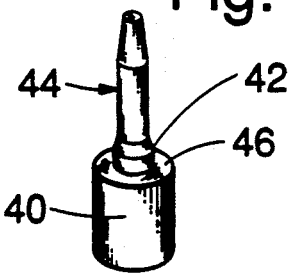
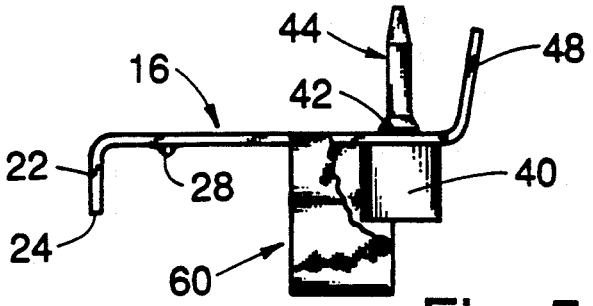
Fig. 5
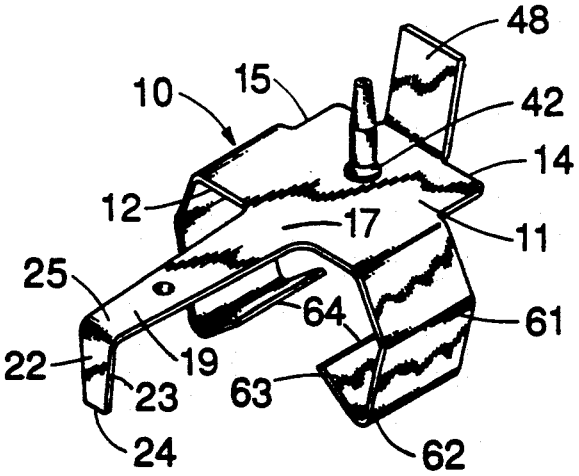
Fig. 6
Fig. 7
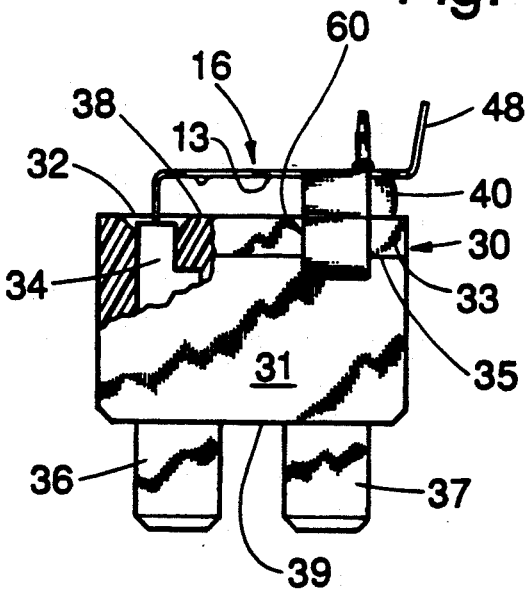
Fig. 8
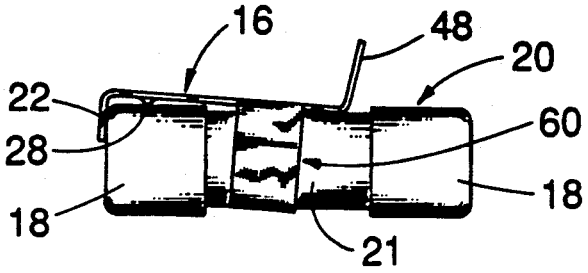

ACCESSORY FUSE CONNECTOR

This is a continuation of copending application Ser. No. 07/531,571 filed on Jun. 1, 1990, now abandoned.

BACKGROUND OF THE INVENTION

1. Field of the Invention

The invention relates to electrical connectors and, more particularly, to accessory connectors for attachment to vehicle fuses.

2. Background Information

The numerous electrical components of vehicles are protected from damage by current overload with replaceable fuses or circuit breakers. These items are most commonly mounted on terminal blocks which are typically located below the vehicle dashboard.

Oftentimes, a vehicle owner may wish to install accessory devices to supplement the original equipment and thereby enhance the utility and enjoyment of his/her vehicle. Rather than altering the original circuitry, various means have been developed for accessing the vehicle electrical system through the terminal block assembly.

For example, U.S. Pat. No. 4,097,109 describes an adapter that can be plugged directly into the vehicle terminal block. The adapter provides a receptacle for connection with an accessory device. It also provides a fuse receptacle for protecting the vehicle circuitry from potential overload problems caused by the device.

While the above adapter is very effective, it is also costly to produce and may not fit all types of vehicle fuse terminal blocks. With many accessory devices that have low current requirements, the noted adapter is excessive, inefficient and sometimes more expensive than the accessory itself.

An attempt to overcome the above problems and provide a simpler fuse adapter is disclosed in U.S. Pat. No. 4,372,638. This adapter can only be used with flat blade fuses. It comprises a folded metal strip having offset legs that fit over the fuse housing and into the female receptacle of a fuse terminal block. The thin legs engage the outer surfaces of the receptacle contacts while the fuse blade simultaneously engages the inner surfaces. The exterior folded portion of the adapter is used as an electrical contact for connection to an accessory device.

Unfortunately, there are fuse types other than blade fuses which are widely used in the vehicle industry. As such, a significant disadvantage of the adapter is its limited utility. Also, the thin legs are structurally weak and may not always make adequate contact with the fuse terminal contacts. Still further, the legs provide very little lateral support and can be easily twisted or bent—especially when one attempts to attach a wire clip to the external folded portion. Additionally, use of the adapter will always be dependent on having sufficient space on the outside of the receptacle opening. Considering the great variety, shape, style and construction of fuse terminal blocks, this could be a frequent impediment.

SUMMARY OF THE INVENTION

The present invention comprises an accessory connector that has releasable attachment means for firm securement to the body of a vehicle fuse. It includes a unique contact arm to provide an electrical connection with the fuse circuitry which, in turn, provides electrical communication with the original vehicle circuitry. And, the connector provides an electrical accessory connector means for allowing electrical communication with a chosen accessory device.

The above combination of features overcomes significant disadvantages of the prior art by providing a universal adapter which is suitable for use with all three of the vehicle fuse types. It is also simple and inexpensive to construct because it can be cut, bent and formed from a single sheet of material having an electrical conductive means such as metal. It could also be constructed of molded plastic with means for conducting electricity such as a conductor strip or conductive fillers. Still further, the connector could comprise a formed sheet of plastic-metal laminate.

Additionally, the connector of the invention is convenient and easy to use. Note that all of the prior art devices require the fuse to be taken-out of the terminal block in order to attach the adaptor. With the present invention, fuse removal is not at all necessary. The connector merely clips into place over the fuse housing as it extends from the terminal block. Also, simple visual observation reveals whether the connector is secure and properly in place on the vehicle fuse.

BRIEF DESCRIPTION OF THE DRAWINGS

FIG. 1 is a top plan view of the accessory fuse connector constructed in accordance with the present invention.

FIG. 2 is a right side elevational view of the connector shown in FIG. 1 with the left side being identical.

FIG. 3 is a back end elevational view of the connector of FIG. 1.

FIG. 4 is an isometric view of a spacer means which may be used in combination with the connector of FIG. 1.

FIG. 5 is a side elevational view of the connector shown in FIG. 1 which is partially broken-away to show the assembly of the spacer means of FIG. 4 and said connector.

FIG. 6 is a perspective view of the assembly shown in FIG. 5.

FIG. 7 is a side elevational view, partially broken away, of the connector assembly shown in FIGS. 5 and 6 attached to a vehicle blade fuse.

FIG. 8 is a side elevational view, partially broken away, of the connector assembly shown in FIG. 1 attached to a glass tube fuse.

FIG. 9 is a side elevational view, partially broken away, of the connector assembly shown in FIGS. 5 and 6 attached to a plastic sheathed fuse.

DESCRIPTION OF THE PREFERRED EMBODIMENTS

With reference now to the drawings, the invention comprises a connector 10 having an electrically conductive body 11 with a front end 12 and a back end 14. The connector is preferably constructed of a flat thin metal plate so that it can be readily cut and bent into the desired shape.

Extending from opposing sides 15 of the connector body are attachment means. Preferably, such means are a continuum of the body and comprise a pair of flexible discreetly bent attachment legs 60. The legs are flexible and coact to releasably grasp the fuse housing sidewalls.

As shown in FIGS. 1-3, the opposing legs are mirror images of each other and have a uniform width which is less than the body width. They bow outwardly from said opposing sides to a cease line 61. They then extend inwardly toward each other to a bottom bend 62. From the bottom bend they curve upwardly and inwardly to form a clamping portion 63. The clamping portion terminates at a free end defined as clamping edge 64.

The clamping edges of each leg are spaced-apart a distance sufficient to provide a firm frictional engagement with the insulative housing portion of any one of at least the three basic automotive fuse types. These are the blade type 30 shown in FIG. 7, the round glass type 20 shown in FIG. 8 and the round plastic sheathed-type 50 shown in FIG. 9.

Each of the basic fuse types includes an insulative housing of glass or plastic of predetermined length for securing a pair of contact elements. Such elements are connected by a fusible conductor and include one or more accessible fuse contact parts which are also in electrical communication with the contact elements.

The blade-type fuse generally comprises a thin polygonal-shaped plastic wafer with two flat metal blades extending coextensively from a bottom end shown by reference 39 in FIG. 7. The aforementioned accessible fuse contact part comprises an upper part or extension of either one or both of the blades which are exposed by respective openings in top end 38 of the wafer housing. Such exposed parts are provided as fuse testing points on all blade-type fuses.

Not only must the connector of the invention accommodate the different types of fuses, it must also be able to make electrical contact with the fuse circuit. To achieve this objective, a connector contact means is shown comprising contact arm 16. The contact arm extends transversely from the front end 12 of the connector body a distance sufficient to engage a predetermined electrical contact point on any one of the aforementioned fuses.

As shown, the contact arm is a narrow electrically conductive flat strip of material lying in the same plane as the connector body 11. Preferably, it is an integral part of the body and extends from the midpoint of end 12 to a distal end portion 19.

With reference to FIG. 8, the arm has sufficient axial extent to span the length of end cap 18 when the connector is clamped to the glass fuse body 21. The arm width is less than the diameter of the glass body and tapers inwardly from its proximal end 17.

The contact arm distal end portion includes an extension means shown as end tab 22 which extends downwardly from terminus 25. Extension points, stiff wires or other geometric structures of the distal end portion could also be used in place of the aforementioned end tab.

With reference to FIGS. 2 and 3, the end tab is proximate the distal end portion and includes side edges 23. The edges taper inwardly toward each other to a bottom contact edge 24. The contact edge is sufficiently narrow so that it can engage the electrically conductive portions of the basic fuse types set forth hereinabove.

With reference to the blade fuse 30 shown in FIG. 7, the connector is positioned on blade housing 31 so that the contact edge is located over top opening 32. Exposed within the opening is the upper part 34 of blade 36. The contact edge has less width than the top opening and the end tab has sufficient length to extend into the opening so that electrical contact is established with the upper part.

With reference to FIG. 9, plastic sheathed fuse 50 is shown with connector 10 attached to an elongated fuse body 52. Typically, the body is solid plastic and includes a central groove 53 that extends along the axial extent of the body. A fusible conductor 54 is located in the groove having contact tips 55 at each opposing end. The conductor may include a notch 56 adjacent one end. Connector 10 is attached to the sheath body so that contact edge 24 will extend into the groove and engage the conductor or notch for electrical communication.

In order to avoid shorting-out the accessory circuit, it is important that the conductive connector body 11 not contact the exposed sheath conductor 54 or the upper part of blade 37 (not shown) of blade fuse 30. To accomplish this purpose, a nonconductive spacer means is used which may be releasably secured to the connector body with a spacer attachment means.

With reference to FIGS. 4–7, the spacer means comprises a spacer body 40 and the spacer attachment means is shown as tapered peg member 44. The peg member extends axially from the center of top surface 46. It includes a tapered shoulder portion 42 which frictionally engages spacer attachment opening 26 of the connector body.

As best seen in FIG. 5, at least the shoulder portion and body are constructed of a resilient nonconductive material such as plastic or rubber. It has a diameter slightly greater than opening 26. In this manner, frictional engagement will occur by inserting the peg through the opening and forcing the shoulder into the opening until the top surface 46 is against body underside 13 of the connector.

Preferably, the spacer body 40 has a diameter less than the width of connector body 11 and a diameter greater than top opening 32 or groove 53. It has a predetermined height which may be equal to, or less than, the length of end tab 22. Its location (along with connector body opening 26), as measured from the end tab, is along the connector body centerline. It is spaced from the end tab a distance less than the length of the overall fuse housings. As shown in FIG. 7, the spacing is about equal to the distance between the centerlines of fuse blades 36, 37.

An additional feature of the spacer means comprises its ability to function as a pivot spring means. In such case, at least the spacer body will be constructed of a resilient rubber-like material.

To illustrate the above, attention is directed to FIG. 7 of the drawings. As shown, the distance between clamping edges 64 and body underside 13, is slightly less than the combined height of spacer body 40 and the width of wafer rim 33. As so dimensioned, the connector 10 is attached by pushing down on the connector body so that the spacer body will be compressed. This action will cause the clamping edges to flex-out over the rim and then move inwardly to engage the rim edge 35.

The above engagement maintains the spacer body in a compressed condition which, in turn, pushes upward on the connector body. Because of the spacer body's axially offset position from the end tab, a pivot movement will result about the spacer body. This will create a lever action on the contact arm and a downward force on the end tab so that a firm engagement of contact edge 24 with upper part 34 will be insured. This is especially desirable considering the vibrations and abrupt movements that a vehicle typically endures.

An action similar to the above occurs with the sheathed fuse shown in FIG. 9. In this arrangement, the relative distances of the fuse body diameter, spacer body and clamping edges, result in compression of the spacer body when the clamping edges are engaged with the fuse body sidewalls. The lever action created thereby tilts the contact arm downwardly and forces the contact edge 24 into firm engagement with conductor 54.

Located at least halfway along the length of the contact arm, is contact projection 28. As best shown in FIG. 8, the projection extends downwardly from the arm underside a distance sufficient to form an electrical contact with end cap 18 of the glass fuse. Most simply, it can be a shallow depression or indentation in the form of a rib, dimple or the like pressed into the arm material during the manufacturing process. The purpose of the projection is to insure that electrical contact is made with end cap 18—particularly in case end tab 22 does not directly abut said end cap. Most desirably, the end tab will directly abut the outer face of the glass fuse end cap.

An accessory device which may be used in conjunction with the invention is an alarm to signal a motorist that the headlights are on after the ignition is off. For this purpose, the connector provides electrical communication from the fuse circuit to the alarm circuitry. Current flow begins from a live fuse contact point, through the contact arm, then the connector body and on to an accessory connector means. Such connector means is an electrical conductor which, most conveniently, is a continuum of the connector body. It is configured to provide easy attachment of an electrical circuit termination means.

With reference to the drawings, the above connector means is shown as male connector tab 48. It comprises an extension of the connector body material which is bent upwardly and outwardly in a direction opposite of end tab 22. The connector extends from the mid-portion of back end 14. Its width and height are sufficient to accommodate standard female mating connectors known in the art.

With the connector 10 attached to a fuse which is installed in a vehicle fuse block, a simple electrical accessing means is provided for installing additional electrically-powered devices. In the case of a vehicle headlight-on alarm, the connector would be attached to the fuse that protects the headlight circuit. The alarm circuit would make electrical connection with male connector 48 and the vehicle ignition circuit. Other vehicle accessories could be installed on the appropriate fuse in a similar fashion. As such, the invention provides a reliable, easily installed fuse connector device without the need for removal of the fuse, rewiring, soldering or the installation of cumbersome adapter assemblies shown in the prior art.

While the invention has been described with respect to specific embodiments, it will be apparent to those skilled in the art that variations, alterations and/or modifications could be made without departing from the spirit and scope of the invention. Accordingly, the invention is to be construed in accordance with the following claims and not by the aforementioned specific illustrative embodiments.

We claim:

1. An accessory fuse connector for a fuse having an insulative housing securing a pair of contact elements connected by a fusible conductor with a fuse contact part in electrical communication with said contact elements, comprising:

a connector body with means for conducting electricity having an upper side and an underside and a front end and a back end;

means extending from said body for attaching the connector to said insulative housing;

a contact arm having electrical conductive means extending from said body to an extension means for making electrical contact with said fuse contact part when the connector is attached to said insulative housing, said extension means comprising a member or combination of members selected from the group consisting of a contact projection and an end tab;

a spacer means attached to said connector body, said spacer means comprising a nonconductive spacer body that extends below the underside of said connector body a predetermined distance, said spacer body and end tab being spaced-apart a distance less than the length of said housing; and, an accessory connector means for providing electrical communication with said connector body and an electrical accessory device.

2. The connector of claim 1 wherein said insulative housing has a predetermined length and said contact arm extends outwardly from said front end to a distal end portion a distance less than said predetermined length.

3. The connector of claim 1 wherein said end tab extends downwardly from the terminus of said distal end portion a distance sufficient to engage said fuse contact part.

4. The connector of claim 3 wherein said end tab terminates at a bottom contact edge.

5. The connector of claim 1 wherein said contact projection comprises an indentation of said contact arm.

6. The connector of claim 1 wherein said spacer means is releasably secured to said connector body with a spacer attachment means.

7. The connector of claim 6 wherein said connector body includes a spacer attachment opening and said spacer means includes a tapered peg member that extends through said opening and forms a frictional engagement with said opening.

8. An electrical connector assembly for attachment to a vehicle fuse, said fuse having contact elements secured to an insulative housing which encloses a fusible conductor, said housing including an accessible fuse contact part in electrical communication with said contact elements, comprising:

a connector body having an integral contact arm extending axially from said body to an end tab for making electrical contact with said fuse contact part, said connector body, contact arm and end tab in electrical communication with each other;

a spacer means attached to said connector body, said spacer means comprising a nonconductive spacer body that extends below an underside of said connector body a predetermined distance, said spacer body and end tab being spaced-apart a distance less than the length of said housing;

an attachment leg extending downwardly from each opposing side of said body, each leg having oppositely facing clamping portions which coact to frictionally engage said insulative housing; and, accessory connector means extending from said connector body for providing electrical communication with said connector body and an electrical accessory device.

9. The assembly of claim 8 wherein said connector body has a back edge and said accessory connector means comprises a male connector tab integral with said connector body and is bent upwardly from said back edge.

10. The assembly of claim 8 wherein said attachment legs are mirror images of each other and bow outwardly from said connector body to a crease line and then extend inwardly to a bottom bend from which each of said clamping portions incline inwardly.

11. The assembly of claim 8 wherein said insulative housing comprises a thin polygonal-shaped plastic wafer, said contact elements comprise two flat blades extending coextensively from a bottom end of the wafer and said fuse contact part comprises an upper part of either one or both of said blades which are exposed by respective openings in a top end of said wafer;

said end tab having a contact edge that enters one of said openings and electrically engages a respective said upper part when said clamping portions engage said wafer.

12. The assembly of claim 11 including an opening in said connector body; said spacer means comprising a spacer body having an axially extending peg member forming a frictional engagement with said opening.

13. The assembly of claim 8 wherein said insulative housing comprises an elongated plastic body with a central groove containing said fusible conductor, said conductor interconnecting contact elements comprising contact tips which are located at opposing ends of said body, said fuse contact part comprising exposed portions of said fusible conductor adjacent an end of said body;

said end tab having a contact edge that engages said conductor when said clamping portions are in frictional engagement with said elongated plastic body.

14. An accessory fuse connector in combination with a fuse having a tubular glass housing of predetermined length which is enclosed at each end by a conductive end cap having an outer face, each of said end caps being interconnected by a fusible conductor, comprising:

a connector body having means extending from said body in frictional engagement with said glass housing for holding said body against said glass housing;

a contact arm extending axially from said body to a downturned end tab, said end tab abutting said outer face of one of the end caps, said connector body, contact arm and end tab in electrical communication with each other;

an electrically conductive contact projection extending downwardly into abutment with said one end cap from an underside of said arm adjacent said end tab; and, accessory connector means extending from said connector body for providing electrical communication with said connector body and an electrical accessory device.

15. The connector of claim 14 wherein said contact projection comprises an indentation of said arm.

* * * * *